US008106286B2

(12) United States Patent
Mizuhiki et al.

(10) Patent No.: US 8,106,286 B2
(45) Date of Patent: Jan. 31, 2012

(54) WAVEFORM GENERATING APPARATUS

(75) Inventors: Takashi Mizuhiki, Hamamatsu (JP); Kazuhide Iwamoto, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 575 days.

(21) Appl. No.: 12/175,334

(22) Filed: Jul. 17, 2008

(65) Prior Publication Data

US 2009/0019992 A1 Jan. 22, 2009

(30) Foreign Application Priority Data

Jul. 18, 2007 (JP) ..... 2007-187691

(51) Int. Cl.
*G10H 1/00* (2006.01)

(52) U.S. Cl. ..... 84/622; 84/659

(58) Field of Classification Search ..... 84/604, 84/609, 622, 645, 649, 659; 370/254–258; 712/28–31
See application file for complete search history.

(56) References Cited

U.S. PATENT DOCUMENTS

| | | | | |
|---|---|---|---|---|
| 5,850,050 | A * | 12/1998 | Isozaki et al. | 84/622 |
| 6,509,519 | B2 | 1/2003 | Tamura | |
| 2006/0054004 | A1 | 3/2006 | Funaki | |

FOREIGN PATENT DOCUMENTS

| | | | |
|---|---|---|---|
| JP | 07-168563 | A | 7/1995 |
| JP | 09-097067 | A | 4/1997 |
| JP | 2002-132262 | A | 5/2002 |
| JP | 2006-065178 | A | 3/2006 |

OTHER PUBLICATIONS

Logic Pro Distributed Audio, Apple Inc., 2007.
Cubase Si Features, Steinberg Canada, 2005.
Fujimoto, K. (2003). "The 109$^{th}$: Clustering System of Audio Signal Processing: Validation of "VST System Link" Executing Distributed Processing with S/PDIF or Adat," *Digital Audio Laboratory,* with English Translation, 16 pages.
Notification of Reason(s) for Refusal mailed Jul. 28, 2009, for JP Patent Application No. 2007-187691, with English Translation, seven pages.

* cited by examiner

*Primary Examiner* — Jeffrey Donels
*Assistant Examiner* — Andrew R Millikin
(74) *Attorney, Agent, or Firm* — Morrison & Foerster LLP

(57) ABSTRACT

In a synthesizer 10, when a function of a tone generation module 312 provided by an external tone generation server 310 is usable, a tone generator control module 102 assigns a necessary number of sound generation channels among sound generation channels of an internal tone generation unit 17 and sound generation channels of the external tone generation module 312, for sound generation corresponding to MIDI data. When assigning the sound generation channel of the tone generation module 312, the tone generator control module 102 transmits, to the tone generation server 310, the MIDI data with identification information of the assigned sound generation channel, thereby causing the sound generation channel indicated by the identification information in the tone generation module 312 to generate waveform data according to the transmitted MIDI data.

5 Claims, 10 Drawing Sheets

FIG. 5

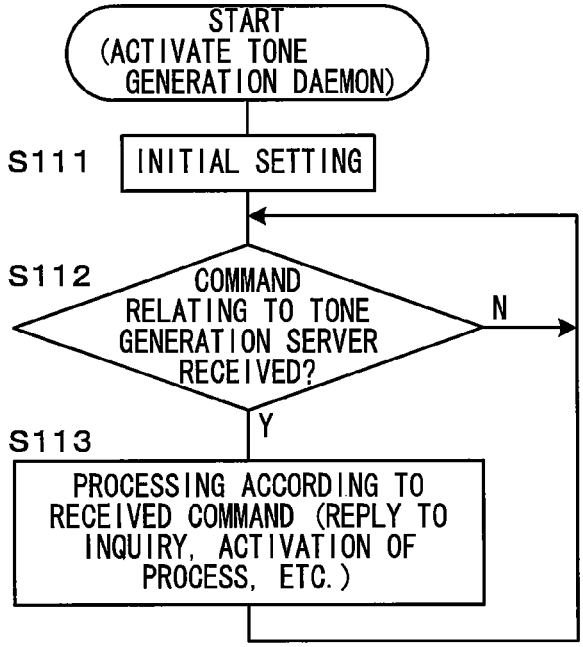

FIG. 6

| COMMAND | PROCESSING EXECUTED ACCORDING TO COMMAND |
|---|---|
| TONE GENERATION FUNCTION INQUIRY | REPLY COMPATIBLE APPARATUS TYPE AND NUMBER OF SOUND GENERATION CHANNELS OF PROVIDABLE TONE GENERATION FUNCTION TO INQUIRER |
| TONE GENERATION SERVER ACTIVATION | START EXECUTING PROGRAM OF TONE GENERATION SERVER TO ACTIVATE TONE GENERATION CONTROL PROCESS AND TONE GENERATOR + MIXER PROCESS AND REPLY RESULT TO TRANSMITTING END |
| INQUIRY ABOUT STATE OF SOUND GENERATION CHANNELS | COLLECT INFORMATION ON STATES OF SOUND GENERATION CHANNELS IN ACTIVATED TONE GENERATOR + MIXER PROCESS AND REPLY TO INQUIRER |
| ⋮ | ⋮ |

FIG. 7

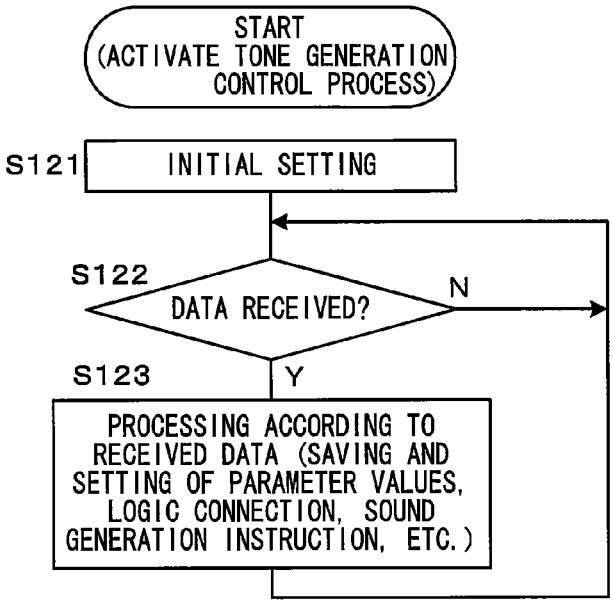

FIG. 8

| RECEIVED DATA | PROCESSING EXECUTED ACCORDING TO DATA |
|---|---|
| TIMBRE NUMBER AND TIMBRE DATA WITH PART NUMBER DESIGNATION | STORE, IN CURRENT TIMBRE DATA MEMORY, RECEIVED TIMBRE NUMBER AND TIMBRE DATA AS DATA OF DESIGNATED PART |
| LOGIC CONNECTION REQUEST | ESTABLISH LOGIC CONNECTION OF DATA TRANSMISSION PATH THROUGH WHICH TONE GENERATION CONTROL PROCESS RECEIVES MIDI DATA FROM CONNECTION REQUESTING APPARATUS VIA MIDI I/O AND WAVEFORM DATA GENERATED BY TONE GENERATOR + MIXER PROCESS IS OUTPUTTED TO CONNECTION REQUESTING APPARATUS FROM WAVEFORM I/O |
| TIMBRE PARAMETER CHANGE INSTRUCTION | CHANGE PARAMETER VALUE IN CURRENT TIMBRE DATA STORED IN CURRENT TIMBRE DATA MEMORY ACCORDING TO CHANGE INSTRUCTION |
| NOTE-ON EVENT(p, nn, vel) WITH CHANNEL NUMBER a' APPENDED | SET PARAMETERS IN CHANNEL REGISTER OF a'-TH SOUND GENERATION CHANNEL REFERRED TO BY TONE GENERATOR + MIXER PROCESS, BASED ON TONE DATA OF p-TH PART STORED IN CURRENT TONE DATA MEMORY, NOTE NUMBER nn, AND VELOCITY vel, AND INSTRUCT START OF SOUND GENERATION OF a'-TH SOUND GENERATION CHANNEL |
| OTHER MIDI DATA WITH CHANNEL NUMBER APPENDED | SET VALUE OF CHANNEL REGISTER ACCORDING TO CONTENT OF MIDI DATA |
| ⋮ | ⋮ |

FIG. 12
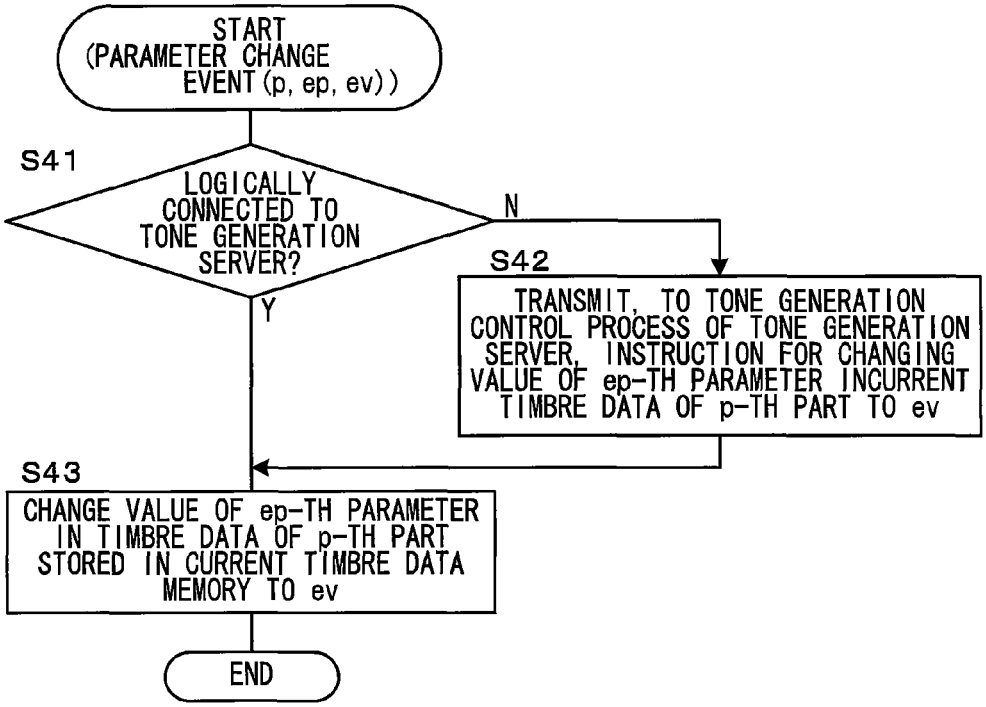
FIG. 13
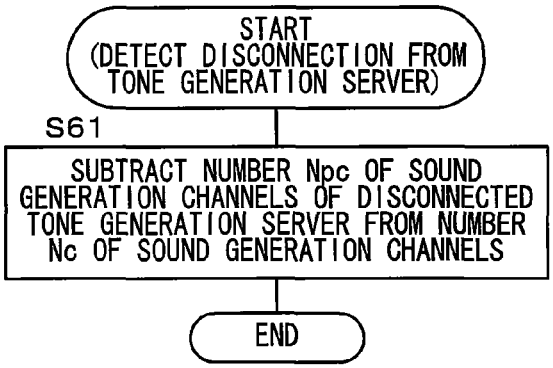
FIG. 14
| TONE GENERATION FUNCTION EXPANDED |
| --- |
| SOUND GENERATION CHANNELS HAS INCREASED BY Npc DUE TO USE OF TONE GENERATION SERVER xx AND TOTALLY Nc CHANNELS ARE AVAILABLE |

WAVEFORM GENERATING APPARATUS

BACKGROUND OF THE INVENTION

1. Field of the Invention

The invention relates to a waveform generating apparatus having a tone generator which generates waveform data in a plurality of sound generation channels based on settings made in the respective sound generation channels. In particular, the invention relates to a waveform generating apparatus capable of communicating with an external information processing apparatus capable of providing a tone generation function.

2. Description of the Related Art

Various apparatuses such as synthesizers and electronic musical instruments have been conventionally known as waveform generating apparatuses having a tone generator. Further, there has been a method for realizing a function of a tone generator by software. In this method, a computer such as a PC (personal computer) executes a desired program such as DAW (digital audio workstation) application.

In these waveform generating apparatuses, when hardware mounted in the apparatus does not have a sufficient capability, a tone generator board or an effector board is mounted as a plug-in board, thereby enabling function addition.

Further, there has been known DAW application which distributes processing to a plurality of network-connected PCs to make the PCs execute their shares of the processing, thereby realizing load sharing and enabling the execution of high-load processing.

Examples of such DAW application include those described in the following Documents 1, 2.

Document 1: "Logic Pro Distributed Audio", [online], 2007, Apple Inc., [retrieved on Jul. 13, 2007], Retrieved from the Internet <URL: http://www.apple.com/logicpro/distributedaudio.html>

Document 2: "Cubase SL Features", [online], 2005, Steinberg Canada, [retrieved on Jul. 13, 2007], Retrieved from the Internet <URL: http://www.steinbergcanada.com/products/cubase/cubasesl_features_systemli nk.htm>

SUMMARY OF THE INVENTION

However, it has not been possible for the aforesaid conventional function expansion methods to offer sufficiently high convenience when a tone generation function is expanded in a waveform generating apparatus such as a synthesizer or an electronic musical instrument which is constructed with dedicated hardware and is often operated in a stand-alone state.

For example, in order to enable the mounting of a plug-in board having a tone generation circuit in a waveform generating apparatus, it is necessary to provide a socket, a communication circuit, a power source, and so on which are dedicatedly prepared for the plug-in board. This results in cost increase and imposes restrictions on designing. Further, a tone generator expanded by the plug-in board is handled as a unit different from the tone generator mounted on the apparatus main body. Therefore, in order to appropriately operate the expanded tone generator, it is necessary not only to set parameters in the tone generator mounted in the main body but also to separately set parameters in the expanded tone generator.

Another known method is to connect a PC to a waveform generating apparatus and causes a function of DAW application executed on the PC to serve as an additional tone generator. In this case, however, the function of the DAW application is defined as an additional function different from the tone generator mounted in the apparatus main body, and this is similar to the case of the plug-in board in view of that it is necessary not only to set parameters in the tone generator mounted in the apparatus main body but also to separately set parameters in the additional tone generator.

The arts described in the Documents 1 and 2 only distribute the processing load among the plural PCs, and cannot provide a sufficient effect in terms of the expansion of a tone generation function in a waveform generating apparatus.

The invention was made to solve the above-described problems, and its object is to make it possible to easily expand a tone generation function of a waveform generating apparatus and to use both the tone generation function of the apparatus main body and the expanded tone generation function in the same manner.

In order to achieve the above objects, a waveform generating apparatus of the invention is a waveform generating apparatus including: a first tone generator capable of generating waveform data of a plurality of channels based on parameters set for each of the channels; a memory that stores timbre data defining tone color of the waveform data to be generated by the first tone generator; a communication device to be connected to a network for communication with a computer connected to the network, the computer having an ability to execute a process of a second tone generator capable of generating waveform data of a plurality of channels based on parameters set for each of the channels; a controller that obtains performance data, including a note-on data instructing to start a sound, in real time and, in response to the performance data, controls at least one of the first tone generator and the second tone generator to generate the waveform data according to the performance data; and a waveform outputting device that mixes the waveform data generated by the first tone generator and the waveform data generated by the second tone generator and transmitted by the computer for receipt by the communication device, and outputs the mixed waveform data, wherein, in a state where the communication device is connected to the network, the controller operates based upon the connection state of the computer to the network, such that when the computer is initially connected to the network, (1-a) the controller transmits an activation command to the computer via the communication device to cause the computer to start the process of the second tone generator, (1-b) the controller sets up communication paths on the network for transporting the performance data from the communication device to the computer and the waveform data generated by the second tone generator from the computer to the communication device, and (1-c) the controller transmits the timbre data stored in the memory to the computer via the communication device, to cause the computer to store the timbre data, and when the computer is connected to the network and the connection paths have been set up on the network, (2-a) in response to the note-on data, the controller assigns at least one channel among the plurality of channels of the first tone generator and the plurality of channels of the second tone generator, (2-b) when assigning the one channel of the first tone generator, the controller sets parameters according to the timbre data stored in the memory and the note-on data to the one channel of the first tone generator and controls the one channel to start the generation of a waveform data based on the parameters set to the one channel, and (2-c) when assigning the one channel of the second tone generator, the controller transmits the note-on data with identification information of the one channel via the communication device, thereby causing the computer to set parameters according to the timbre data stored in the computer and the note-on data to the one channel of the second tone generator, the computer controlling the one channel to start the generation of a waveform data based on the parameter set to the one channel of the second tone generator.

Preferably, in the above waveform generating apparatus, the controller further operates based upon the connection state of the computer to the network, such that when the computer is not connected to the network, (3-a) in response to the note-on data, the controller assigns at least one channel, among the plurality of channels of the first tone generator, and (3-b) the controller sets parameters according to the timbre data stored in the memory and the note-on data to the one channel and controls the one channel to start the generation of a waveform data based on the parameters set to the one channel.

Preferably, the above waveform generating apparatus further includes: an operation device that accepts an edit operation of the timbre data by a user; and a timbre editor that edits the timbre data stored in the memory according to the edit operation on the operation device, wherein when the computer is connected to the network and the connection paths have been set up on the network, the timbre editor further controls the computer to edit the timbre data stored in the computer via the communication device, in the same way that the timbre editor edits the timbre data stored in the memory, according to the edit operation on the operation device.

Preferably, the above waveform generating apparatus further includes: a timbre library storing a plurality of timbre data; an operation device that accepts a selection operation by a user; and a timbre selecting device that selects one of the plurality of timbre data stored in the timbre library according to the selection operation on the operation device and stores the selected timbre data into the memory, wherein when the computer is connected to the network and the connection paths have been set up on the network, the timbre selecting device further transmits the selected timbre data to the computer to cause the computer to store the transmitted timbre data.

Preferably, the above waveform generating apparatus further includes a notifying device that notifies a user of that the second tone generator is available in addition to the first tone generator and the number of channels usable for the generation of the waveform data is increased, when the computer is connected to the network and the connection paths are set up on the network.

The above and other object, features and advantages of the invention will be apparent from the following detailed description which is to be read in conjunction with the accompanying drawings.

BRIEF DESCRIPTION OF THE DRAWINGS

FIG. 5 is a flowchart of processing of a tone generation daemon executed by a CPU of the PC;

FIG. 6 is a view showing examples of processing executed at Step S113 in FIG. 5;

FIG. 7 is a flowchart of processing of a tone generation control process executed by the CPU of the PC;

FIG. 8 is a view showing examples of processing executed at Step S123 in FIG. 7;

FIG. 12 is a flowchart of processing that the CPU of the synthesizer executes when detecting a parameter change event;

FIG. 13 is a flowchart of processing that the CPU of the synthesizer executes when detecting disconnection from a tone generation server; and FIG. 14 is a view showing an example of display in which the synthesizer notifies a function expansion state.

DETAILED DESCRIPTION OF THE PREFERRED EMBODIMENTS

Hereinafter, the best mode for carrying out the invention will be concretely described based on the drawings.

Figure 1:
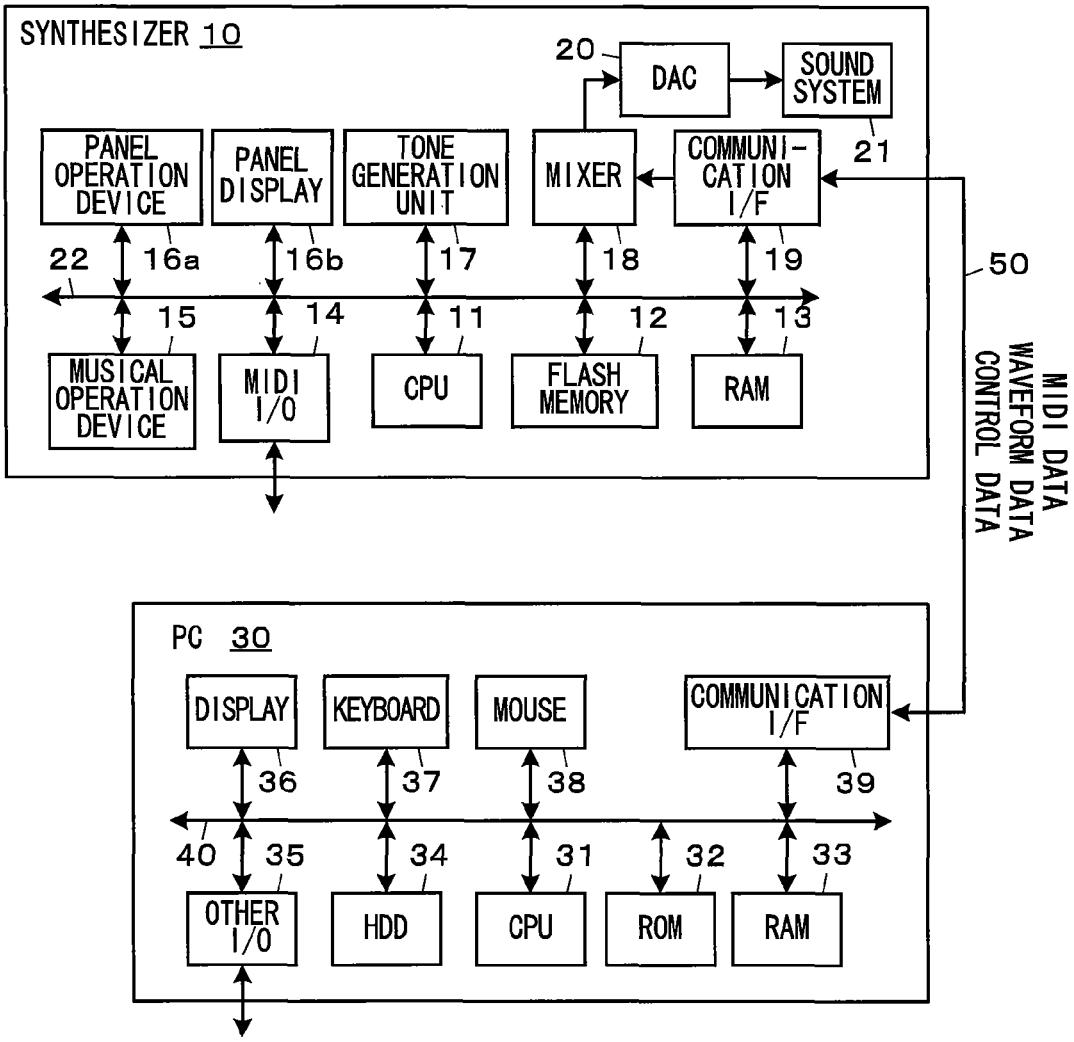
FIG. 1 is a view showing the hardware configuration of a synthesizer as an embodiment of a waveform generating apparatus of the invention, and a PC capable of providing a tone generation function to the synthesizer.

First, FIG. 1 shows the hardware configuration of a synthesizer as an embodiment of a waveform generating apparatus of the invention and a PC capable of providing a tone generation function to the synthesizer.

As shown in FIG. 1, a synthesizer 10 includes a CPU 11, a flash memory 12, a RAM 13, a MIDI (Musical Instruments Digital Interface) I/O (input/output unit) 14, a musical operation device 15, a panel operation device 16*a*, a panel display 16*b*, a tone generation unit 17, a mixer 18, and a communication I/F 19, all of which are connected via a bus line 22. In addition, the synthesizer 10 includes a DAC (digital/analog converter) 20 and a sound system 21.

The CPU 11, which is a controller centrally controlling the synthesizer 10, executes desired control programs stored in the flash memory 12 to detect the operation contents of the musical operation device 15 and the panel operation device 16a, and perform various control operations such as control over the display by the panel display 16b, control over transmission/receipt of MIDI data via the MIDI I/O 14, control over transmission/receipt of MIDI data, waveform data, control data, and the like via the communication I/F 19, control over waveform data generation by the tone generation unit 17, and control over mixing by the mixer 18.

The flash memory 12 is a memory storing the control programs executed by the CPU 11, data requiring no change, and the like.

The RAM 13 is a memory used as a work memory of the CPU 11 and storing values of temporarily used parameters and so on.

The MIDI I/O 14 is an interface transmitting/receiving the MIDI data to/from an external apparatus.

The musical operation device 15 includes controls such as a keyboard and pedals accepting a performance operation by a user.

The panel operation device 16*a* includes controls, such as keys, knobs, sliders, and pitchbenders, for accepting user's setting operations regarding the operation of the synthesizer 10.

The panel display 16*b* is composed of a liquid crystal display (LCD), light-emitting diode (LED) lamps, and so on and is a display displaying an operation state and setting contents of the synthesizer 10, a message to a user, a graphical user interface (GUI) for accepting user's instructions, and so on.

Stacking a touch panel on the LCD enables the integral structure of the panel display 16*b* and the panel operation device 16*a*.

The tone generation unit 17 is a first tone generator which generates digital waveform data (audio waveform data) in a plurality of, for example, 128 sound generation channels based on settings made in the respective sound generation channels.

In order to control a waveform data generation operation of the tone generation unit 17, the CPU 11 functioning as a tone generator controller appropriately sets values of parameters in channel registers corresponding to sound generation channels assigned for sound generation, according to tone color, pitch, intensity, envelope, and so on of sound to be generated, and gives instructions for the sound generation start/stop, dump (rapid attenuation), and so on to the sound generation channels.

The mixer 18 is a waveform outputting device which accumulates the waveform data generated in the respective sound generation channels of the tone generation unit 17 while weighting the waveform data for each of L and R stereo channels, and mixes the resultant waveform data and waveform data which is received from an external apparatus such as the PC 30 via the communication I/F 19, to output the mixed resultant stereo waveform data for each sampling period. When no waveform data is received from the communication I/F 19, only the waveform data generated by the tone generation unit 17 are accumulated.

The communication I/F 19 is an interface for communication with an external apparatus such as the PC 30 via an appropriate communication path (network) 50. The communication path 50 may be wired or wireless, or may be one having or not having an interconnection device, but an adopted communication path needs to enable real-time transmission (with several millisecond transmission delay time or less) at least regarding the transmission of the MIDI data and the receipt of the digital waveform data by the synthesizer 10 and enable the transmission of control data such as commands and timbre data by the synthesizer 10. A possible adopted example is MLAN utilizing IEEE 1394. Another possible alternative is USB (Universal Serial Bus). Of course, it is not limited to one-to-one communication path.

The DAC 20 has a function of converting the digital waveform data outputted from the mixer 18 into analog audio signals to supply the analog audio signals to the sound system 21.

The sound system 21 is a sound outputting device formed by a speaker or like and outputs sound according to the audio signals supplied from the DAC 20.

The synthesizer 10 as described above is capable of generating and outputting musical sound having tone color designated by a user, according to a performance operation by the user. The synthesizer 10 can output musical sound of automatic performance in the same manner.

On the other hand, the PC 30 includes a CPU 31, a ROM 32, a RAM 33, a HDD 34, other 1/0 35, a display 36, a keyboard 37, a pointing device such as a mouse 38, and a communication I/F 39, and these components are connected by a bus line 40 via not shown interfaces as required. As these components, known hardware may be appropriately used.

However, as the communication I/F 39, one conforming to the standard enabling the communication with the synthesizer 10 via the communication path 50 adopted in the synthesizer 10 is used.

As hardware of the CPU 31 and so on, used is one capable of realizing a function of a later-described tone generation server by executing an appropriate program. The program itself may be stored in the ROM 32 or the HDD 34 in advance or may be downloaded from an external part as necessary.

The PC 30 need not be constantly connected to the synthesizer 10, but only has to be connected to the synthesizer 10 at an arbitrary timing when the expansion of the tone generation function of the synthesizer 10 is required. This connection makes it possible to configure musical sound (waveform) generating systems with both the synthesizer 10 and the PC 30.

Figure 2:
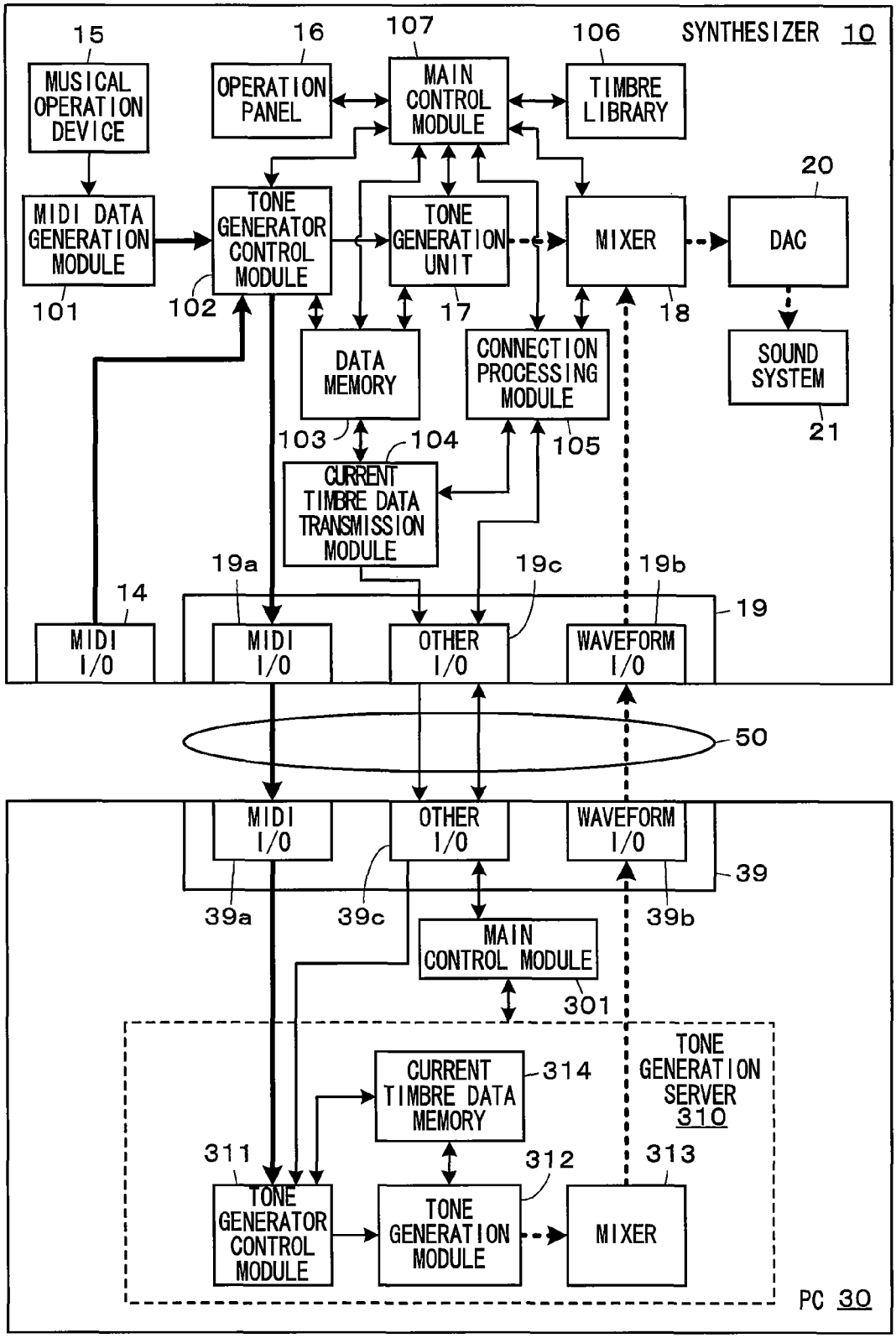
FIG. 2 is a view showing the functional configuration of the synthesizer and the PC shown in FIG. 1.

Next, FIG. 2 shows the functional configuration of the synthesizer 10 and the PC 30 shown in FIG. 1.

In FIG. 2, the thick solid arrows represent transmission paths of the MIDI data and the thick broken arrows represent transmission paths of the waveform data.

As shown in FIG. 2, the synthesizer 10 has functions of a MIDI data generation module 101, a tone generator control module 102, a current timbre data memory 103, a current timbre data transmission module 104, a connection processing module 105, a timbre library 106, and a main control module 107, in addition to the functions realized by the respective constituent elements shown in FIG. 1, that is, the MIDI I/O 14~the sound system 21 (in FIG. 2, the panel operation device 16*a* and the panel display 16*b* are combined and shown as an operation panel 16). The functions of the MIDI data generation module 101~the main control module 107 are realized by the CPU 11 executing desired programs to control various kinds of hardware included in the synthesizer 10.

The PC 30 has functions of a main control module 301 and the tone generation server 310.

Hereinafter, the functions of the respective modules will be described.

First, the MIDI data generation module 101 of the synthesizer 10 has functions of detecting the contents of a performance operation performed to the musical operation device 15 and generating MIDI data (note-on, note-off, and the like) indicating the contents of the operation. Then, the MIDI data generation module 101 supplies the generated MIDI data to the sound control module 102 so that the sound control module 102 controls the tone generation unit 17 according to the MIDI data.

The synthesizer 10 is capable of generating waveform data of a plurality of parts as will be described later. For this purpose, the MIDI data generation module 101 grasps a correspondence relation between ranges of controls in the musical operation device 15 and parts for whose performance the controls are used. When the MIDI data is generated according to the operation of the musical operation device 15, the MIDI data generation module 101 appends an appropriate part number (MIDI channel) to the generated MIDI data according to the correspondence relation. The correspondence relation between the musical operation device 15 and the parts is changeable by operating the operation panel 16.

The tone generator control module 102 has a function of controlling the waveform data generation operation in the tone generation unit 17 based on various MIDI data which are performance data defining the performance contents of a musical composition, such as MIDI data generated by the MIDI data generation module 101, MIDI data received from an external apparatus such as a MIDI sequencer via the MIDI I/O 14, or MIDI data generated by the main control module 107 based on the operation in the operation panel 16 or based on music data for automatic performance.

This control includes processing for assigning the sound generation channels to the sound generation corresponding to the MIDI data. At the time of this assignment, the synthesizer 10 is connected to the PC 30, and if a tone generation module 312 included in the tone generation server 310 is also usable for the sound generation, the tone generator control module 102 performs this assignment without making any distinction between the sound generation channels of the tone generation unit 17 on the synthesizer 10 side and sound generation channels of the tone generation module 312 on the tone generation server 310 side.

When assigning the sound generation channels of the tone generation module 312 of the tone generation server 310, the tone generator control module 102 appends the number (identification information) of the sound generation channel used for the sound generation to the received MIDI data and transmits the MIDI data to the tone generation server 310 of the PC 30. Consequently, a tone generator control module 311 included in the tone generation server 310 controls the tone generation module 312 according to the contents of the MIDI data so that the tone generation module 312 generates waveform data. A correspondence relation between the numbers assigned to the sound generation channels and the tone generation unit/module to which the sound generation channels belong is managed by the tone generator control module 102, and the main control module 107 also grasps this correspondence relation.

Further, the MIDI data is transmitted from a MIDI I/O 19*a* included in the communication I/F 19 and is received by a MIDI I/O 39*a* included in the communication I/F 39 of the PC 30.

In FIG. 2, the communication I/Fs 19 and 39 include three kinds of I/Os, that is, the MIDI I/Os 19*a*, 39*a*, waveform I/Os 19*b*, 39*b*, other I/Os 19*c* and 39*c*, but these I/Os need not be physically independent of one another, and a band of data transfer via the communication path 50 may be appropriately divided into sub-bands for inputting/outputting of these three kinds of data.

The tone generator control module 102 further has functions relating to the registration of current timbre data into the current timbre data memory and the editing of the current timbre data, which will be described in the description of the current timbre data memory 103 and the current timbre data transmission module 104.

The current timbre data memory 103 is a memory storing the current timbre data defining the tone color of the waveform data generated by the tone generation unit 17. When detecting MIDI data indicating a program change event, the tone generator control module 102 reads the timbre data indicated by the program change event from the timbre library 106 via the main control module 107, and sets the read timbre data in the current timbre data memory 103 as the current timbre data.

Then, in every sampling period, the timbre generation unit 17 reads the waveform data from a read address of the current timbre data memory 103, which address is determined according to a value of a parameter set in a channel register, and generates waveform data by applying interpolation and envelope processing to the read waveform data.

Figure 3:
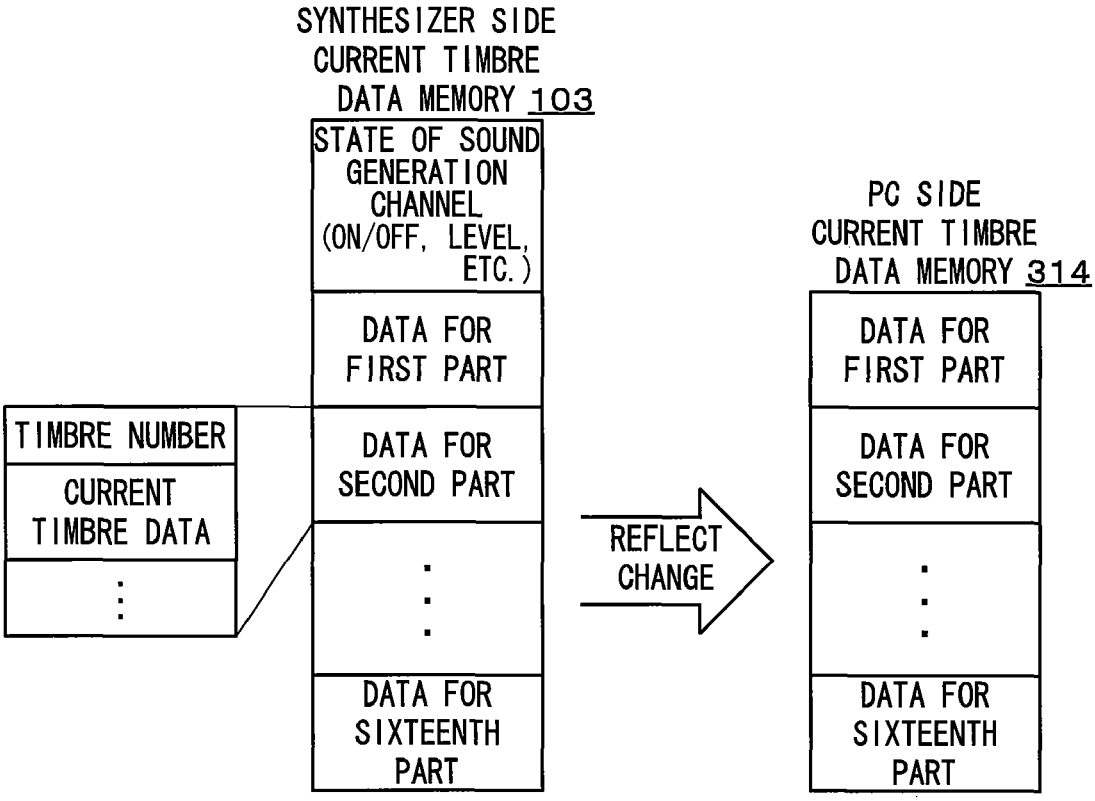
FIG. 3 is a view showing the structure of data stored in a current timbre data memory shown in FIG. 2.

Here, FIG. 3 shows the structure of data stored in the current timbre data memory 103.

As shown in FIG. 3, the current timbre data can be stored on per performance part basis. Here, timbre data for 16 parts can be stored in the current timbre data memory 103. Therefore, the tone generation unit 17 can generate waveform data whose tone colors differ depending on the performance parts. Further, the timbre numbers of the current timbre data for the respective parts are stored in the current timbre data memory 103.

Information indicating the states of the respective sound generation channels are further stored in the current timbre data memory 103. Examples of the information include information indicating whether the sound generation channels are busy or idle (ON or OFF), information indicating whether or not, in a sound generation channel which has started the sound generation in response to a note-on event and thus is busy, a note-off event corresponding to the note-on event has occurred (when the note-off event occurs, attenuation (release) state occurs), and information indicating level of sound being generated (waveform data).

In the current timbre data memory 103, information regarding the sound generation channels of the tone generation unit 17 of the synthesizer 10 and information regarding the sound generation channels of the tone generation module 312 of the tone generation server 310 are both stored. In order to write the information regarding the tone generation unit 17 of the synthesizer 10 into the current timbre data memory 103, the main control module 107 obtains the information from the tone generation unit 17.

As for the information regarding the tone generation module 312, the main control module 107 may obtain necessary information by periodically transmitting an inquiry to the tone generation server 310, or a function of periodically transmitting the necessary information to the main control module 107 may be provided in the tone generation server 310 so that the main control module 107 can register the information in the current timbre data memory 103. In the synthesizer 10, the former structure is adopted.

Let us return to the explanation of FIG. 2.

The current timbre data transmission module 104 has a function of transmitting, when the contents of the current timbre data memory 103 are changed while logic connection for data transfer is established between the synthesizer 10 and the tone generation server 310, the contents of the change to the tone generation server 310 based on the contents of the change notified by the tone generator control module 102 so that the contents of a current timbre data memory 314 provided in the tone generation server 310 undergo the same change as the change made in the current timbre data memory 103. This change includes a change according to the selection of new tone color in response to a program change event and a change according to the editing of a timbre parameter in response to an operation in the operation panel 16.

The current timbre data transmission module 104 has a function of transmitting the contents of the current timbre data memory 103 to the tone generation server 310 based on the notification form the connection processing module 105 when the logic connection between the synthesizer 10 and the tone generation server 310 is newly established, thereby causing the transmitted contents to be stored in the current timbre data memory 314.

Owing to these functions, the timbre data stored in the current timbre data memory 103 of the synthesizer 10 and the timbre data stored in the current timbre data memory 314 of the tone generation server 310 can constantly have the same contents as shown in FIG. 3. The contents of the change in the timbre data are transmitted from the other I/O 19*c* and received by the other I/O 39*c* of the PC 30.

The information regarding the states of the sound generation channels need not be stored in the current timbre data memory 314.

The connection processing module 105 has a function of causing the PC 30 to activate the tone generation server 310 when the synthesizer 10 and the PC 30 are newly connected, and establishing the logic connection between the synthesizer 10 and the tone generation server 310.

The timbre library 106 is a memory storing a plurality of timbre data usable by the synthesizer 10. Timbre data which is selected as data used for performance according to the operation in the operation panel 16 or the designation in music data is read from the timbre library 106 and stored in the current timbre data memory 103 to be used for the generation of the waveform data in the tone generation unit 17.

It is also possible to edit the timbre data stored in the timbre library 106 and register new timbre data in the timbre library 106 by the operation in the operation panel 16.

The main control module 107 has a function of controlling the various units and modules of the synthesizer 10 so that these units and modules can appropriately exhibit the functions described above. The main control module 107 further executes the detection of an operation in the operation panel 16 and the display on the operation panel 16.

On the other hand, the main control module 301 of the PC 30 has a function of managing functions of the tone generation server 310 that can be provided in the PC 30. It further has a function of providing information regarding the functions of the tone generation server 310 that can be provided, and activating the tone generation server 310, in response to a request from the synthesizer 10.

Further, the tone generation server 310 is activated when necessary, and in response to a request from an external apparatus, it provides a function of a second tone generator which generates stereo digital waveform data in a plurality of sound generation channels based on settings made in the respective sound generation channels and outputs the generated digital waveform data to the external part. The function of the tone generation server 310 need not be constantly activated, but only has to be activated by the CPU 31 starting the execution of a desired program when the synthesizer 10 gives an activation request of the tone generation server function.

Another possible structure is to install, in the PC 30, a plurality of programs for realizing the function of the tone generation server 310 and selectively activate/stop these programs, thereby enabling the arbitrary use of the plural tone generation servers 310 having different functions according to the purpose.

The tone generation server 310 has the tone generator control module 311, the tone generation module 312, a mixer 313, and the current timbre data memory 314. These modules have substantially the same functions as those of the tone generator control module 102, the tone generation unit 17, the mixer 18, and the current timbre data memory 103 of the synthesizer 10.

However, the tone generator control module 311 does not perform the assignment of the sound generation channels to the sound generation, but controls the sound generation channels indicated by the sound generation channel numbers appended to the MIDI data received from the tone generator control module 102 so that these sound generation channels generate waveform data according to the MIDI data.

Further, while controlling volumes in each of the stereo L and R channels, the mixer 313 accumulates the waveform data for the same sampling period generated in the respective sound generation channels of the tone generation module 312, and transmits the generated stereo waveform data to the synthesizer 10 so that the waveform data is supplied for use in the mixing process in the mixer 18 in each sampling period. The waveform data is transmitted from the waveform I/O 39*b* included in the communication I/F 39 and is received by the waveform I/O 19*b* included in the communication I/F 19 of the synthesizer 10.

Then, while controlling volumes in each of the stereo L and R channels, the mixer 18 of the synthesizer 10 accumulates the waveform data generated in the respective sound generation channels of the tone generation unit 17 of the synthesizer 10, and mixes the resultant waveform data with the stereo waveform data supplied from the mixer 313, so that it is possible to obtain waveform data as if the tone generation unit 17 and the tone generation module 312 were functioning as one tone generation unit to execute the sound generation to which the tone generator control module 102 has assigned the sound generation channels.

Next, processing executed by the CPUs of the aforesaid synthesizer 10 and PC 30 will be described.

Figure 4:
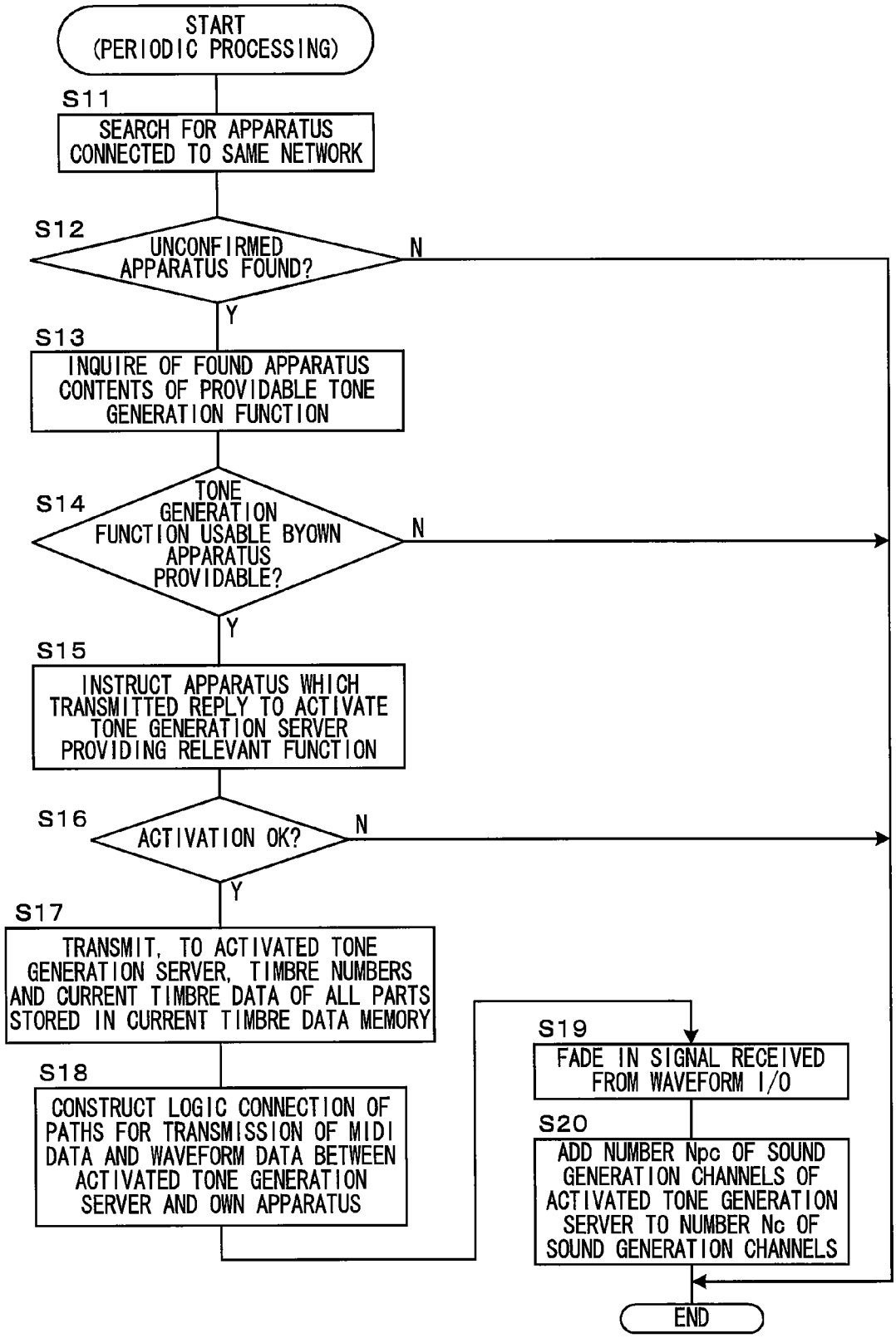
FIG. 4 is a flowchart of connection confirmation processing periodically executed by a CPU of the synthesizer.

First, FIG. 4 shows a flowchart of connection confirmation processing periodically executed by the CPU 11 of the synthesizer 10. Further, FIG. 5 shows a flowchart of processing of a tone generation daemon executed by the CPU 31 of the PC 30, and FIG. 6 shows a concrete example of processing which is executed during the processing in FIG. 5 according to a received command.

The processing shown in FIG. 4 corresponds to the function of the connection processing module 105 shown in FIG. 2. The CPU 11 of the synthesizer 10 starts the processing shown in FIG. 4 at periodic timings, and first searches for an apparatus connected to the same network (S11). The purpose of this search is to find what kind of apparatus is connected in a range to which the MIDI data and the waveform data can be transmitted real-time via the communication I/F 19. An appropriate protocol according to the communication standard can be used for this search. Further, information indicating what kind of apparatus is connected to the network is kept based on the results of the past search.

Then, it is determined whether or not an unconfirmed apparatus has been found by the search at Step S11 (S12), and if any unconfirmed apparatus is found, the CPU 11 inquires of the found apparatus the contents of a tone generation function that the found apparatus can provide (S13). Here, the unconfirmed apparatus is an apparatus not found in the last search or an apparatus whose information on a tone generation server function has not been obtained.

Meanwhile, the CPU 31 of the PC 30 starts the processing of the tone generation daemon shown in FIG. 5, automatically upon power-on of the PC 30 or in response to a user's activation instruction. This processing corresponds to the function of the main control module 301 shown in FIG. 2, and the CPU 31 executes this processing as a background service or a system process.

This processing is to accept a request from an external apparatus such as the synthesizer 10 to execute processing corresponding to the request. Specifically, after making required initial settings (S111), the CPU 31 waits until a command regarding the tone generation server is received (S112), and when the command is received, the CPU 31 executes the processing according to the received command (S113). Examples of this processing include replying to the inquiry and activating processes, as shown in FIG. 6. Then, after completing the processing or after instructing another process to execute processing, the CPU 31 returns to Step S112 again to wait for the next command.

The inquiry by the CPU 11 at Step S13 in FIG. 4 is given by means of a tone generation function inquiry command acceptable by the tone generation daemon, and when receiving the command while the tone generation daemon is activated, the PC 30 transmits a reply indicating the tone generation function that it can provide, that is, a compatible machine type and the number of the sound generation channels of the tone generation server 310 activatable in the PC 30, as shown in FIG. 6.

A program realizing the function of the tone generation server 310 is installed in the HDD 34 as a plug-in to the tone generation daemon. Then, on start-up, the tone generation daemon searches for the program for realizing the function of the tone generation server 310 which program is placed in a predetermined plug-in folder in the HDD 34, reads a manufacturer's name, a compatible apparatus type, the number of sound generation channels, version information, and so on from a file of each found program, and creates a tone generator table in which these pieces of information are registered as information on the tone generation server 310 that can be provided. Then, the tone generation daemon replies to the tone generation function inquiry command based on the information in the tone generator table.

When receiving the reply to the inquiry transmitted at Step S13, the CPU 11 of the synthesizer 10 determines whether or not the inquiry destination apparatus (here, the PC 30) can provide the tone generation function usable by the own apparatus, based on the information on the compatible apparatus type (S14). When the tone generation daemon is not activated in the inquiry destination apparatus, no reply to the inquiry is received, and in this case, the determination at Step S14 results in NO.

Then, if NO at Step S14, the processing is ended here, but if YES, the designation of the tone generation server which provides the tone generation function usable by the own apparatus and an activation instruction of the tone generation server are given to the apparatus which transmitted the reply (S15). If a plurality of tone generation servers are usable, a user may be made to select which of the tone generation servers is to be activated. This activation instruction is given by means of a tone generation server activation command acceptable by the tone generation daemon.

Accordingly, the CPU 31 of the PC 30 reads the program for realizing the function of the designated tone generation server from the HDD 34 into the RAM 33, starts executing the program, and returns the result in reply, as shown in FIG. 6. As a result, a tone generation control process and a tone generator+mixer process are activated. The tone generation control process performs processing corresponding to the function of the tone generator control module 311 shown in FIG. 2, and the tone generator+mixer process performs processing corresponding to the functions of the tone generation module 312 and the mixer 313.

Here, FIG. 7 shows a flowchart of the processing of the tone generation control process executed by the CPU 31, and FIG. 8 shows a concrete example of processing which is executed according to received data during the processing in FIG. 7.

When the tone generation daemon instructs the activation of the tone generation control process, the CPU 31 starts executing this processing as a background service or a system process.

In this processing, data is received from an external apparatus or other process and processing according to the data is executed. Specifically, after making required initial settings (S121), the CPU 31 waits until some data is received (S122), and when some data is received, the CPU 31 executes processing according to the received data (S123). Examples of this processing include saving and setting of values of parameters, logic connection, sound generation instruction, and so on as shown in FIG. 8. Then, after completing the processing, the CPU 31 returns to Step S122 again to wait for the next command.

Let us return to the explanation of FIG. 4.

When determining, based on the reply from the PC 30, that the tone generation server function has been activated (S16), the CPU 11 transmits, to the activated tone generation server (here, the tone generation server 310), the timbre numbers and the current timbre data of all the parts stored in the current timbre data memory 103 together with the designation of the part numbers (S17).

Accordingly, the CPU 31 of the PC 30 stores the timbre numbers and the current timbre data of the respective parts received from the synthesizer 10 in the current timbre data memory 314 as the timbre numbers and current timbre data of the designated parts as shown in FIG. 8. Consequently, the same timbre numbers and current timbre data are stored in the current timbre data memories of the synthesizer 10 and the tone generation server 310.

Further, the CPU 11 constructs the logic connection of paths for transmitting the MIDI data and the waveform data between the activated tone generation server and the own apparatus (S18).

Concretely, first, the CPU 11 and the CPU 31 cooperate to set, in the network 50, a real-time transmission path of the MIDI data from the synthesizer 10 to the PC 30 (MIDI transmission path) and a real-time transmission path of the waveform data from the PC 30 to the synthesizer 10 (waveform transmission path), and to establish the connection so that the MIDI data from the tone generator control module 102 is supplied to the MIDI transmission path and the waveform data from the waveform transmission path is supplied to the mixer 18. Then, the CPU 11 requests the CPU 31 for the logic connection of the activated tone generation server 310 to these MIDI transmission path and waveform transmission path.

In response to the request the CPU 31 establishes the logic connection of a data transmission path through which the tone generation control process receives the MIDI data from the connection requesting apparatus (here, the synthesizer 10) via the MIDI I/O 39*a*, and the waveform data generated by the tone generator+mixer process is outputted from the waveform I/O 39*b* to the connection requesting apparatus, as shown in FIG. 8.

Concretely, the connection is established so that the MIDI data received via the MIDI transmission path is supplied to the process of the tone generator control module 311, and the connection is established so that the waveform data outputted from the process of the mixer 313 is supplied to the waveform transmission path. The state where the tone generator control module 102 of the synthesizer 10 and the tone generator control module 311 of the PC 30 are thus connected via the MIDI transmission path and the mixer 313 of the PC 30 and the mixer 18 of the synthesizer 10 are thus connected via the waveform transmission path, that is, the state where the tone generation function can be expanded by the PC 30 will be called "logic connection established state".

In this state, the MIDI data is transmitted from the tone generator control module 102 of the synthesizer 10 to the tone generator control module 311 of the tone generation server 310, and the waveform data generated in the tone generation module 312 of the tone generation server 310 and mixed in the mixer 313 is received by the mixer 18 of the synthesizer 10, so that the received waveform data can be mixed with the waveform data generated by the tone generation unit 17.

When completing the above processing, the CPU 11 causes the mixer 18 to fade in a signal received from the waveform I/O 39*b* (S19). Thereafter, the number Npc of the sound generation channels of the activated tone generation server is added to the number Nc of the assignable sound generation channels, and thereafter the sound generation channels of the sound generation unit 17 and the sound generation module 312 are all defined as sound generation channels that the tone generator control module 102 can use for the assignment to the sound generation (S20), and thereafter, the processing is ended.

After the above processing is finished, the user of the synthesizer 10 can use the tone generation module 312 of the tone generation server 310 for the generation of the waveform data completely in the same manner as he/she uses the tone generation unit 17 of the synthesizer 10. In this case, the user does not have to perform any setting operation to the PC 30, but only need to connect the PC 30 to a network to which the synthesizer 10 belongs (the tone generation daemon, if not self-activated type, has to be activated).

When an activation OK reply is not received within a predetermined time after Step S15, an activation failure determination is made at Step S16, and the processing is ended.

Next, processing that the synthesizer 10 and the tone generation server 310 execute in order to generate the waveform data will be described.

Figure 9:
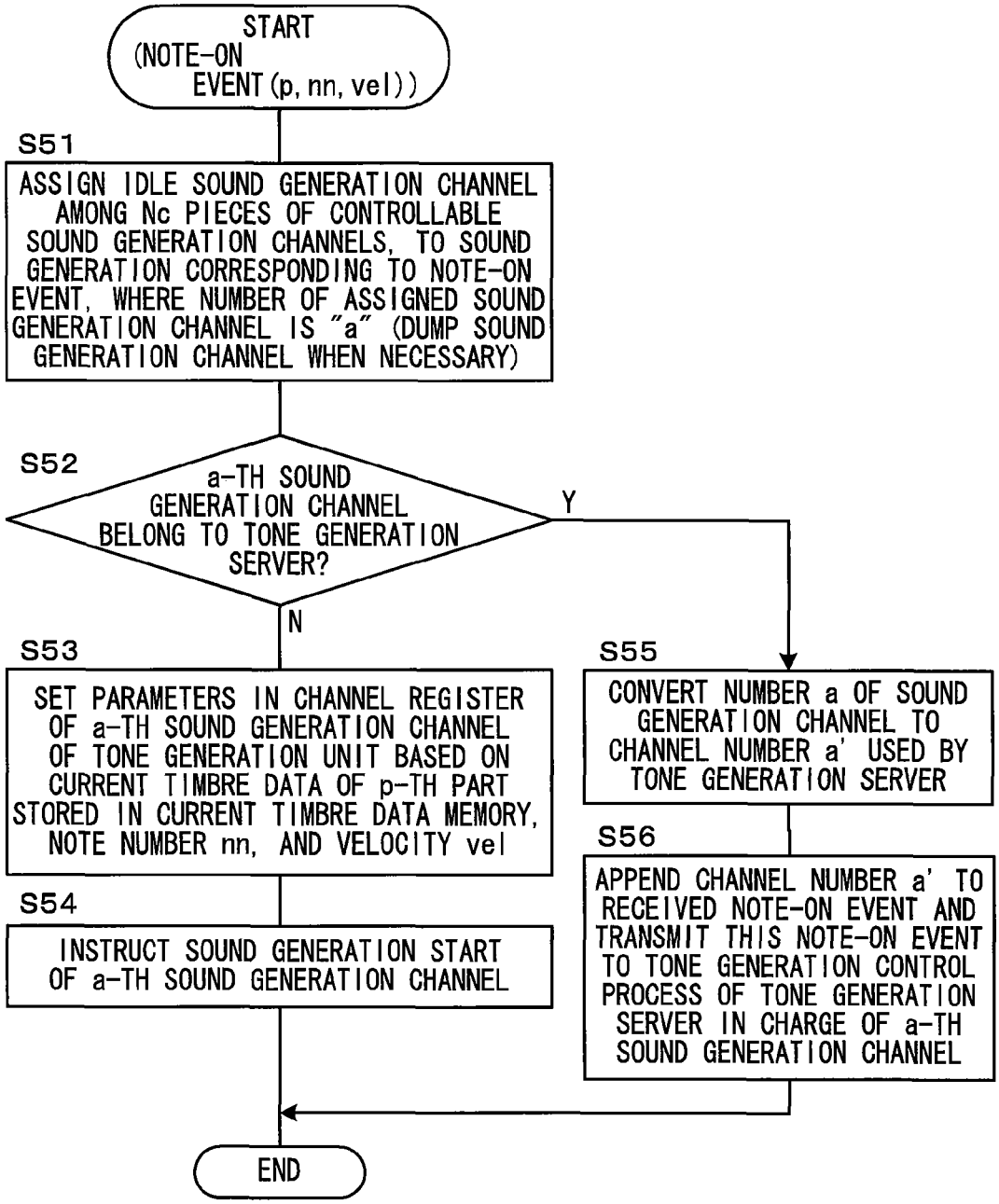
FIG. 9 is a flowchart of processing that the CPU of the synthesizer executes when detecting a note-on event.

First, FIG. 9 shows a flowchart of processing that the CPU 11 of the synthesizer 10 executes when detecting a note-on event.

This processing relates to the function of the tone generator control module 102, and is started when MIDI data indicating a note-on event is supplied to the tone generator control module 102. In the MIDI data indicating the note-on event, the part number p, the note number nn, and velocity vel of sound to be generated are written.

In this processing, the CPU 11 first assigns an arbitrary idle sound generation channel, among Nc pieces of the controllable sound generation channels, for sound generation corresponding to the note-on event, where the number of this sound generation channel is "a" (S51).

Incidentally, when all the sound generation channels are busy, a sound generation channel with low output level or a sound generation channel in which note-off has been already performed is appropriately selected, output thereof is dumped (truncate processing), and this sound generation channel is assigned. As a basis of this assignment, data on the states of the sound generation channels stored in the current timbre data memory 103 can be used. Further, as a concrete method for deciding, at Step S51, which sound generation channel among Nc pieces of the sound generation channels is to be assigned, an appropriate generally known method may be applied, assuming that Nc pieces of the sound generation channels all belong to the tone generation unit 17 of the synthesizer 10.

Next, it is determined whether or not the assigned a-th sound generation channel is a channel of the tone generation server 310 (S52). It is assumed that the tone generator control module 102 has information on the correspondence relation between the numbers assigned to the sound generation channels and the tone generation units/modules to which the sound generation channels belong.

Then, if NO at Step S52, the CPU 11 sets values of parameters in a channel register of the a-th sound generation channel of the tone generation unit 17 based on current timbre data of a p-th part stored in the current timbre data memory 103, the note number nn, and the velocity vel, in order to cause the tone generation unit 17 of the own apparatus to generate sound according to the note-on event (S53), and instructs the sound generation start of the a-th sound generation channel (S54). Then, the processing is ended.

Meanwhile, in every predetermined sampling period, the tone generation unit 17 refers to the contents of the channel resisters of the respective sound generation channels, and when finding the instruction for the sound generation start in any of the channel registers, the tone generation unit 17 generates waveform data according to the values of the parameters registered in the relevant channel register. Therefore, as a result of the processing at Steps S53 and S54, it is possible to cause the tone generation unit 17 to generate the waveform data in the a-th sound generation channel according to the contents of the note-on event.

Incidentally, the parameters set at Step S53 include a read start address of the waveform data included in the timbre data, progress rate of a waveform data read address according to the waveform data to be read and pitch indicated by the note number nn, the shape of waveform envelope according to amplitude indicated by the velocity vel, and so on. Further, if waveform data which differ depending on the note number and the range of the velocity are used in the used timbre data, the read start address and the progress rate differ in values depending on the note number nn and the velocity vel.

On the other hand, if YES at Step S52, the number "a" of the assigned sound generation channel is converted to a channel number a' used by the tone generation server 310 (S55). For example, such a situation may occur that, the synthesizer 10 side numbers the sound generation channels of the tone generation unit 17 as 1 to 128, and numbers the sound generation channels of the tone generation module 312 as 129 to 256, but on the other hand, the tone generation server 310 side numbers the sound generation channels of the tone generation module 312 as 1 to 128 without giving any consideration to the sound generation channels of the synthesizer 10. In this case, a'=a−128. This processing is not necessary if a negotiation function of making the synthesizer 10 and the tone generation server 310 assign the common numbers to the sound generation channels.

After Step S55, the CPU 11 appends the sound generation channel number a' to the note-on event which triggered the start of this processing, and transmits this note-on event to the tone generation control process of the tone generation server 310 in charge of the a-th sound generation channel (S56), and then ends the processing.

On the PC 30 side, when the CPU 31 executing the tone generation control process receives the note-on event with the channel number a' being appended, which is transmitted from the synthesizer 10 at the processing of Step S56, the CPU 31 sets parameters and a sound generation start instruction in a channel register of the a'-th sound generation channel referred to by the tone generator+mixer process, as shown in FIG. 8.

This processing is the same as the processing at Step S53 where the tone generation unit 17 of the synthesizer 10 is made to generate the waveform data, except in that the used current timbre data is stored in the current timbre data memory 314.

As a result of the above processing, the synthesizer 10 can assign the sound generation channels of the tone generation module 312 of the tone generation server 310 to the sound generation corresponding to the note-on event, in completely the same manner as it assigns the sound generation channels of the tone generation unit 17 of the own apparatus, and can make these sound generation channels generate the waveform data according to the contents of the note-on event.

When the logic connection is not established between the synthesizer 10 and the tone generation server 310, the sound generation channels of the tone generation unit 17 are necessarily assigned to the sound generation, and therefore, the determination at Step S52 is always NO and the processing at Steps S55 and S56 is not executed.

Further, when detecting another event, such as a note-off event, necessitating the specification of a sound generation channel and the control over the tone generation unit/module, the CPU 11 behaves in the same manner as it behaves in the processing at and after Step S52 in FIG. 9. Specifically, when an instruction to the sound generation channel of the tone generation server 310 is necessary, the number of the sound generation channel to which the instruction has to be given is appended to MIDI data indicating the detected event, and this MIDI data is transmitted to the tone generation control process of the tone generation server 310 in charge of this sound generation channel. Then, on the PC 30 side, the CPU 31 executing the tone generation control process sets values in a channel register corresponding to the channel number appended to the received MIDI data, according to the contents of the MIDI data, as shown in FIG. 8.

Therefore, even when an event other than the note-on event occurs, the synthesizer 10 can also control the sound generation channels of the tone generation module 312 of the tone generation server 310 in completely the same manner as it controls the sound generation channels of the tone generation unit 17 of the own apparatus. Further, the synthesizer 10 can behave in the same manner also when the specific sound generation channel is dumped at Step S51.

Figure 10:
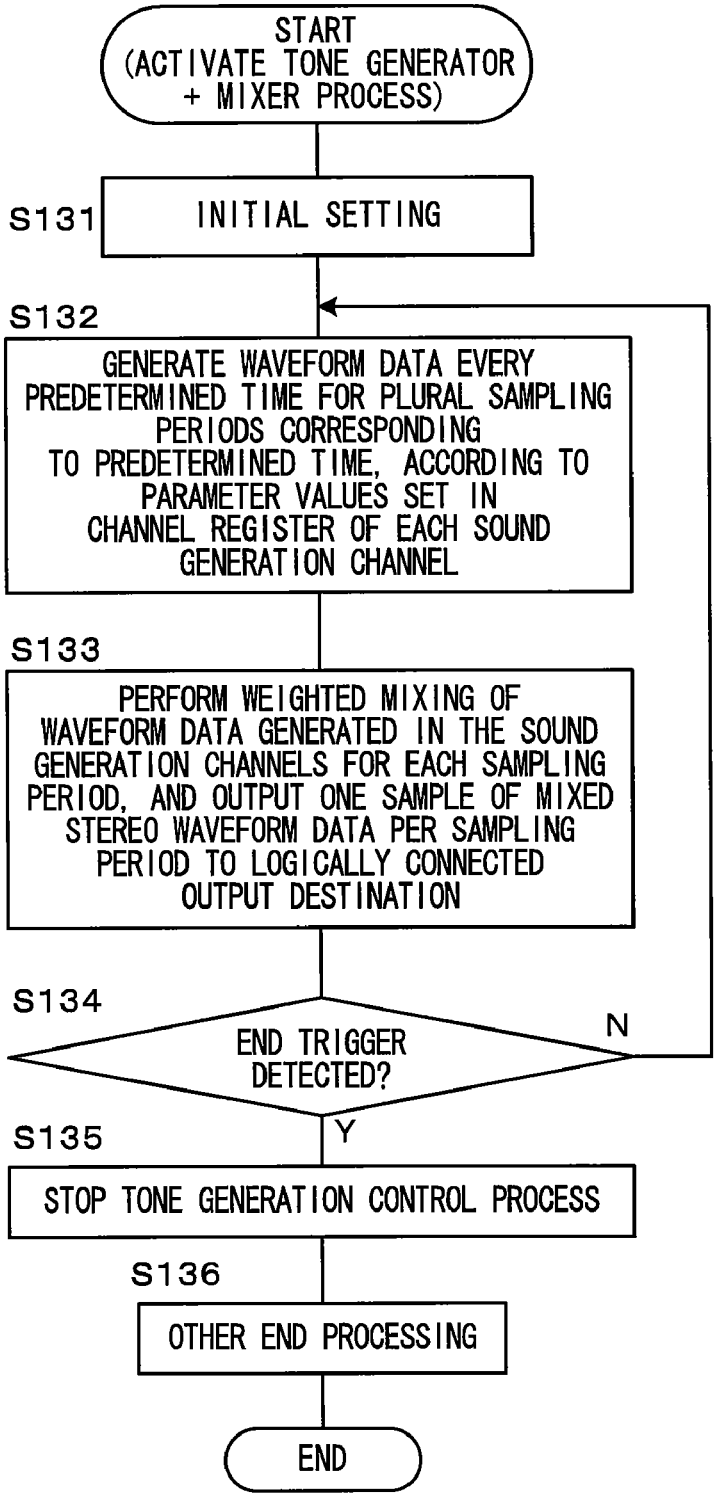
FIG. 10 is a flowchart of processing of a tone generator+mixer process executed by the CPU of the PC.

FIG. 10 shows a flowchart of the tone generator+mixer process executed by the CPU 31 of the PC 30.

When the tone generation daemon instructs the activation, the CPU 31 starts executing this processing as a background service or a system process.

Then, after performing required initial processing (S131), waveform data for a plurality of sampling periods corresponding to a predetermined time are generated every predetermined time, according to values of parameters set in the channel register of each of the sound generation channels (S132). Further, weighted mixing of the waveform data generated in the sound generation channels for each sampling period is performed, and one sample of the synthesized stereo waveform data per sampling period is outputted to a logically connected output destination (here, the synthesizer 10) (S133).

Then, these processing operations are repeated until an end trigger such as the disconnection from the output destination or the operation stop of the PC 30 is detected (S134). When the end trigger is detected, the tone generation control process is stopped (S135) and at the same time, processing necessary for ending the process such as canceling the logic connection is executed (S136). Then, the processing is ended.

In the tone generator+mixer process, the waveform data for later sampling periods are generated in advance and stored in a cache register at Step S132 in order to facilitate the timing management when the waveform data is outputted at Step S133, but the method of generating the waveform data for each sampling is the same as that used by the tone generation unit 17.

Therefore, when the tone generation unit 17 is made to generate the waveform data, and when the tone generation module 312 is made to generate the waveform data, it is possible to obtain the equivalent waveform data.

Figure 11:
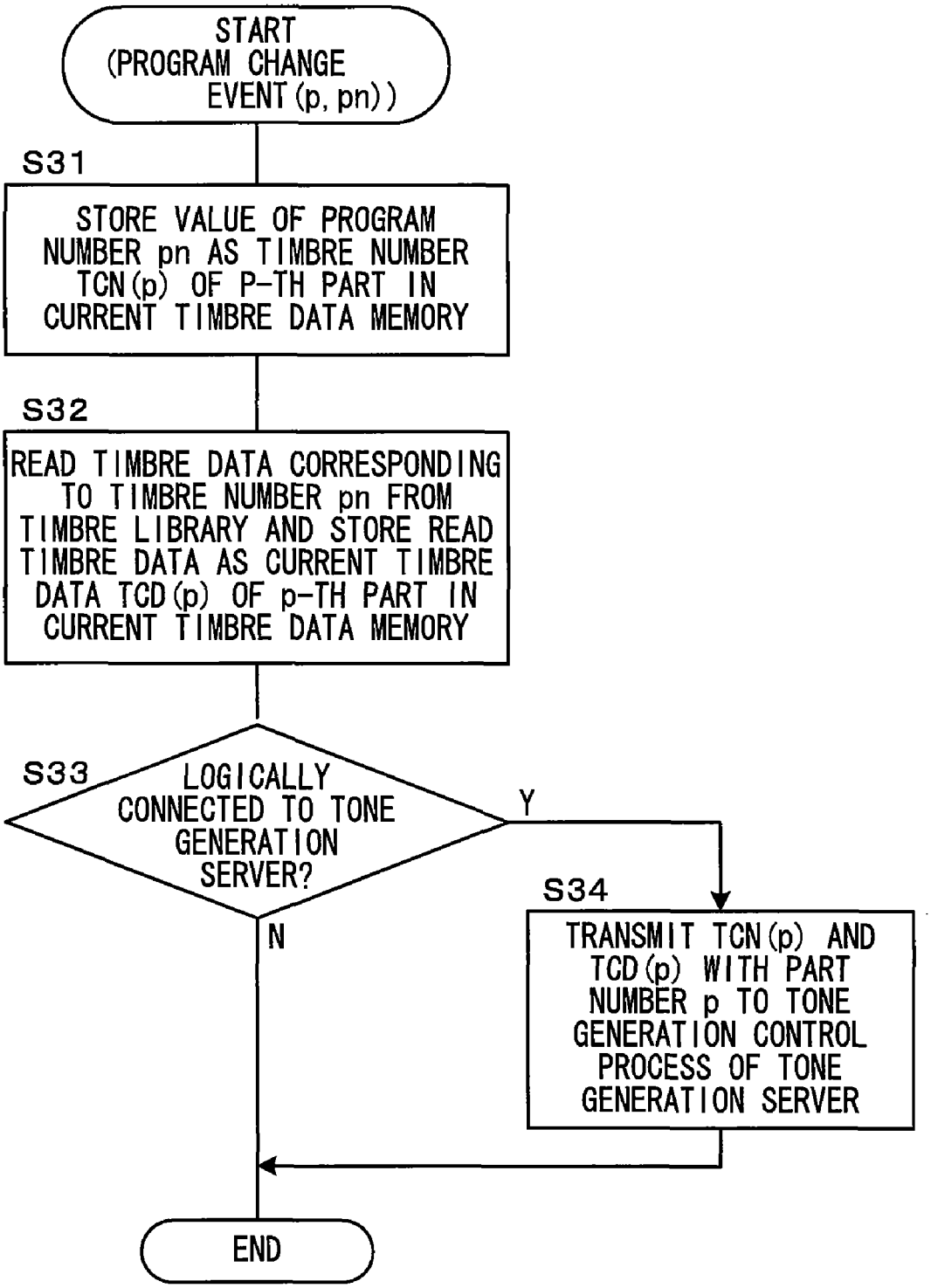
FIG. 11 is a flowchart of processing that the CPU of the synthesizer executes when detecting a program change event.

Next, FIG. 11 shows a flowchart of processing that the CPU 11 of the synthesizer 10 executes when detecting a program change event.

This processing relates to the functions of the main control module 107 and the current timbre data transmission module 104, and when the main control module 107 receives MIDI data indicating a program change from the MIDI I/O 14 via the tone generator control module 102, or when an operation of selecting timbre data corresponding to the timbre number pn for the p-th part is performed in the operation panel 16, this processing is started. Incidentally, in the MIDI data indicating the program change, the part number p of a part whose timbre is to be set and the program number pn indicating the timbre data number of the timbre to be set are written, and the MIDI event of the program change and the selection operation of the timbre data are equivalent.

In this processing, the CPU 11 first sets a value of the program number pn as the timbre number TCN(p) of the p-th part in the current timbre data memory 103 (S31). Thereafter, the CPU 11 reads the timbre data corresponding to the timbre number pn from the timbre library 106 and stores the timbre data in the current timbre data memory 103 as current timbre data TCD(p) of the p-th part (S32).

Then, if the logic connection to the tone generation server is not established, the processing is ended here (S33), but if the logic connection is established, the CPU 11 transmits the timbre number TCN(p) and the current timbre data TCD(p) set at Step S31 and Step S32 together with the part number p to the tone generation control process of the tone generation server 310 (S34).

In response to the transmitted data, the CPU 31 of the PC 30 stores the timbre numbers and the current timbre data of the respective parts received from the synthesizer 10, as the timbre numbers and the current timbre data of the designated parts in the current timbre data memory 314, as shown in FIG. 8. In this case, data previously stored as data of the designated parts are discarded, and the received data are stored as new current timbre data and so on.

FIG. 12 shows a flowchart of processing that the CPU 11 of the synthesizer 10 executes when detecting a parameter change event.

This processing is processing also relating to the functions of the main control module 107 and the current timbre data transmission module 104, similarly to the processing in FIG. 11, and is started when the main control module 107 receives MIDI data indicating a request for changing a value of a parameter of the current timbre data (parameter change event as a system exclusive event), from the MIDI I/O 14 via the tone generator control module 102, or when an operation for changing a value of an ep-th parameter of the current timbre data of the p-th part to ev is performed in the operation panel.

In this parameter change event, the part number p indicating a part whose parameter value of the current timbre data is to be changed, the parameter number ep indicating a parameter whose value is to be changed, and the changed value ev indicating the value of the parameter after the change are written.

In this processing, the CPU 11 first determines whether or not the logic connection to the tone generation server is established (S41), and if the logic connection is established, it transmits, to the tone generation control process of the tone generation server 310, an instruction to change the value of the ep-th parameter of the current timbre data of the p-th part to ev (S42).

In response to the change instruction, the CPU 31 of the PC 30 changes the value of the parameter in the current timbre data stored in the current timbre data memory 314, according to the change instruction transmitted from the synthesizer 10, as shown in FIG. 8.

Further, on the synthesizer 10 side, the CPU 11 changes the value of the ep-th parameter in the current timbre data of the p-th part stored in the current timbre data memory 103 to ev (S43), and then ends the processing.

When the timbre used for the generation of the waveform data is changed or its parameter is edited on the synthesizer 10 side, the synthesizer 10 can quickly reflect the change in the tone generation server 310 side by executing the above processing in FIG. 11 and FIG. 12. Therefore, even when the current timbre data is changed, it is possible to maintain the state where the tone generation unit 17 and the tone generation module 312 can perform the same waveform data generation operation.

Next, FIG. 13 shows a flowchart of processing that the CPU 11 of the synthesizer 10 executes when detecting disconnection from the tone generation server.

When waveform data is no longer received from the tone generation server to which the logic connection has been established, the CPU 11 of the synthesizer 10 determines that the connection to the tone generation server has been cut off. Then, the CPU 11 executes the processing shown in FIG. 13, and subtracts the number Npc of the sound generation channels of the disconnected tone generation server from the number Nc of the sound generation channels (S61). In this case, even if the sound generation in the sound generation channels of the disconnected tone generation server is in progress, it is not necessary to re-assign the sound generation channels for this sound generation.

Then, from this processing on, only the sound generation channels of the tone generation unit 17 are used for the assignment to the sound generation, without using the sound generation channels of the disconnected tone generation server. When the disconnection is detected, the mixer 18 automatically mutes an input from the waveform I/O 19*b* by means of hardware.

The above processing makes it possible to continue the waveform data generation within the capability of the synthesizer 10, in the same manner as before the disconnection, even when the logic connection to the tone generation server is cut off due to cut off of the physical connection to the PC 30 is cut off, the operation stop of the PC 30 or the like. Further, when the connection to the PC 30 is resumed, it is possible to re-establish the connection by the processing shown in FIG. 4.

According to the synthesizer 10 described above, by connecting the PC 30 capable of providing the tone generation function, it is possible to expand the tone generation function of the main body and use the expanded tone generation function in the same manner as when the tone generation function of the main body is used. At this time, it is possible to expand the function automatically as if the number of the sound generation channels of the tone generation unit of the main body were increased, without requiring any new setting by a user, and therefore, it is possible to use the expanded function with great ease.

Here, the description of the embodiment is finished, and it goes without saying that the hardware configuration, the functional configuration, the data structure, the concrete processing contents, and so on of the apparatus are not limited to those described in the above embodiment.

For example, the above embodiment describes the example where the processes realizing the functions of the tone generation daemon and the tone generation server 310 which operate in the PC 30 side are executed as a background service or a system process, but DAW application as application may be made usable for such purposes.

Further, as the timbre data, timbre data defining one tone color by a plurality of element tones is usable. In this case, a plurality of sound generation channels are assigned for the sound generation corresponding to one note-on event and waveform data relating to different element tones are generated in the respective sound generation channels, but in the assignment itself of the sound generation channels, it is enough that the necessary number of sound generation channels are assigned as is done at Step S51 in FIG. 9. Then, when the sound generation channels of the tone generation server are assigned, not only the numbers of the assigned sound generation channels but also the designation of the element tones to be generated are appended to the note-on event, and this note-on event is transmitted to the sound control process.

Then, the tone generation control process causes the assigned sound generation channels to generate sound according to the designated element tones included in the current timbre data determined for each part. Consequently, the tone generation module 312 of the tone generation server 310 can generate the appropriate waveform data relating to the element tones, similarly to the tone generation unit 17 of the synthesizer 10.

In the above-described embodiment, only one tone generation server is shown as the tone generation server logically connected to the synthesizer 10, but the simultaneous logic connection between the synthesizer 10 and a plurality of tone generation servers is also possible. In this case, the synthesizer 10 is logically connected separately to the tone generation servers, and the assignment of the sound generation channels can be performed on assumption that the number of the sound generation channels of the synthesizer 10 is increased by the total number of the sound generation channels that can be provided by the respective tone generation servers.

In this case, the mixer 18 receives the waveform data generated by the tone generation modules of the tone generation servers, separately from the respective tone generation servers in a time division manner, a band division manner, or the like, and finally mixes the waveform data generated by the tone generation unit of the synthesizer 10 and the waveform data generated by the tone generation modules of all the logically connected tone generation servers, and outputs the resultant waveform data. Then, when the logic connection to any of the tone generation servers is cut off, only the waveform data received from this tone generation server is muted and the mixing processing is continued.

In these cases, one apparatus may provide the functions of the plural tone generation servers or a plurality of apparatuses may provide the functions of the respective tone generation servers.

When the number of the sound generation channels usable for the sound generation is increased in the synthesizer 10 owing to the logic connection to the tone generation server, the increment number of the sound generation channels and the number of the usable sound generation channels may be notified by the display shown in FIG. 14 on the panel display 16*b*. Alternatively, a mark or the like indicating the state of the function expansion may be simply displayed. This can offer still higher convenience since a user can easily recognize that the tone generation function has been appropriately expanded.

In the above-described embodiment, the MIDI transmission path for the real-time transmission of the MIDI data is set in addition to the transmission path for the transmission/receipt of various commands, but if the data format of the commands is made distinguishable from the format of the MIDI data, the MIDI data may be transmitted by using the same transmission path as that for the transmission of the commands. This eliminates the need for setting a new MIDI transmission path in the communication path 50 at the time of the logic connection at Step S18 in FIG. 4.

Further, it goes without saying that the invention is applicable not only to a synthesizer but also to any waveform generating apparatus, such as an electronic musical instrument, having a tone generator. In this case, the musical operation device may be in any form such as a stringed musical instrument, a wind instrument, or a percussion instrument, instead of a keyboard. The musical operation device and the sound system themselves are not indispensable constituent elements, and the invention may be any apparatus generating waveform data according to performance data inputted from an external part to output the waveform data to an external recorder or the like.

Further, even if the apparatus providing the tone generation server function is not a general-purpose computer such as a PC but is a dedicated tone generating apparatus, the same effects can be obtained in view of that the functional expansion can be automatically made as if the number of the sound generation channels of the tone generation unit of the main body were increased, without requiring any new setting by a user.

The modification examples described above are applicable in any combination within a consistent range.

As is apparent from the above description, according to the waveform generating apparatus of the invention, it is possible to easily expand the tone generation function of the waveform generating apparatus and to use the expanded tone generation function in the same manner as when the tone generation function of the main body is used.

Therefore, it is possible to provide a highly convenient waveform generating apparatus.

What is claimed is:

1. A waveform generating system comprising a waveform generating apparatus and a computer, connectable with each other via a network, wherein the computer stores a tone generation program executable by the computer to function as an expansion tone generator, which can be accessed by the waveform generating apparatus, generating waveform data of a plurality of channels based on parameters set for each of the channels, and comprises a device for mutually communicating with the waveform generating device via the network, and wherein the waveform generating apparatus comprises:

a tone generator generating waveform data of a plurality of channels based on parameters set for each of the channels;

a memory that stores timbre data defining tone color of the waveform data to be generated by the tone generator;

a communication device for communicating with the computer when the waveform generating device is connected to the computer via the network;

a controller that obtains performance data, including a note-on data instructing to start a sound, in real time and, in response to the performance data, controls at least one of the tone generator and the expansion tone generator provided by the tone generation program executed by the computer to generate the waveform data according to the performance data; and a waveform outputting device that mixes the waveform data generated by the tone generator and the waveform data generated by the expansion tone generator provided by the tone generation program executed by the computer and transmitted by the computer to the communication device, and outputs the mixed waveform data, and in a state where the communication device is connected to the network, the controller operates based upon the connection state of the computer to the network, such that when the computer is initially connected to the network, the controller transmits an activation command to the computer via the communication device to instruct the computer to activate the tone generation program, the controller sets up communication paths on the network for transporting the performance data from the communication device to the computer and the waveform data generated by the expansion tone generator provided by the tone generation program executed by the computer from the computer to the communication device, and the controller transmits the timbre data stored in the memory to the computer via the communication device, to cause the computer to store the timbre data, when the computer is connected to the network and the connection paths have been set up on the network, in response to the note-on data, the controller assigns at least one channel among the plurality of channels of the tone generator and the plurality of channels of the expansion tone generator provided by the tone generation program executed by the computer, when assigning a channel of the tone generator, the controller sets parameters to the assigned channel according to the timbre data stored in the memory and the note-on data and controls the assigned channel to start generation of a waveform data based on the parameters set to the assigned channel of the tone generator, and when assigning a channel of the expansion tone generator, the controller transmits the note-on data with identification information of the assigned channel via the communication device, thereby instructing the computer to set parameters to the assigned channel according to the timbre data stored in the computer and the note-on data, the computer controlling the assigned channel to start generation of a waveform data based on the parameter set to the assigned channel of the expansion tone generator, and when the computer is not connected to the network, in response to the note-on data, the controller assigns at least one channel among the plurality of channels of the tone generator, and the controller sets parameters to the assigned channel according to the timbre data stored in the memory and the note-on data and controls the assigned channel to start generation of a waveform data based on the parameters set to the assigned channel.

2. The waveform generating system according to claim 1, wherein the computer stores plural kinds of the tone generation programs, in response to receiving the activation command from the waveform generating apparatus, based on the activation command, selectively activates one of the tone generation programs which is compliant to the waveform generating apparatus among the plural kinds of the tone generation programs, and functions as the expansion tone generator compliant to the waveform generating apparatus based on the selectively activated tone generation program.

3. A waveform generating system according to claim 1, wherein the waveform generating apparatus comprises:

an operation device that accepts an edit operation of the timbre data by a user; and a timbre editor that edits the timbre data stored in said memory according to the edit operation on said operation device, and when the computer is connected to the network and the connection paths have been set up on the network, when editing the timbre data stored in the memory, said timbre editor further controls the computer to edit the timbre data stored in the computer via the communication device, in the same way that said the timbre editor edits the timbre data stored in the memory, according to the edit operation on the operation device.

4. A waveform generating apparatus system according to claim 1, wherein the waveform generating apparatus comprises:

a timbre library storing a plurality of timbre data;

an operation device that accepts a selection operation by a user; and a timbre selecting device that selects one of the plurality of timbre data stored in the timbre library according to the selection operation on the operation device and stores the selected timbre data into the memory, and when the computer is connected to the network and the connection paths have been set up on the network, when storing the selected timbre data into the memory, the timbre selecting device further transmits the selected timbre data to the computer to instruct the computer to store the transmitted timbre data.

5. A waveform generating system according to claim 1, wherein the waveform generating apparatus comprises a notifying device that notifies a user that the expansion tone generator is available in addition to the tone generator and that the number of channels available for generation of waveform data is increased, when the computer is connected to the network and the connection paths are set up on the network.

* * * * *